US009973861B2

(12) United States Patent
Rosenkranz et al.

(10) Patent No.: US 9,973,861 B2
(45) Date of Patent: May 15, 2018

(54) METHOD FOR OPERATING A HEARING AID AND HEARING AID

(71) Applicant: SIVANTOS PTE. LTD., Singapore (SG)

(72) Inventors: Tobias Daniel Rosenkranz, Erlangen (DE); Homayoun Kamkar Parsi, Erlangen (DE); Marko Lugger, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days. days.

(21) Appl. No.: 15/068,867

(22) Filed: Mar. 14, 2016

(65) Prior Publication Data

US 2016/0269834 A1 Sep. 15, 2016

(30) Foreign Application Priority Data

Mar. 13, 2015 (DE) ..... 10 2015 204 639

(51) Int. Cl.
*H04R 25/00* (2006.01)

(52) U.S. Cl.
CPC ..... *H04R 25/305* (2013.01); *H04R 25/356* (2013.01); *H04R 25/505* (2013.01); *H04R 2225/43* (2013.01)

(58) Field of Classification Search
CPC .. H04R 25/356; H04R 25/305; H04R 25/505; H04R 2225/43
USPC ..... 381/317, 318
See application file for complete search history.

(56) References Cited

U.S. PATENT DOCUMENTS

| | | | | |
|---|---|---|---|---|
| 7,039,195 | B1 | 5/2006 | Svean et al. | |
| 7,853,031 | B2 | 12/2010 | Hamacher | |
| 9,271,091 | B2 | 2/2016 | Zurbrugg | |
| 9,532,897 | B2 * | 1/2017 | Huber | A61F 5/58 |
| 2011/0137649 | A1 | 6/2011 | Rasmussen et al. | |
| 2015/0230036 | A1 * | 8/2015 | Pedersen | H04R 1/1041 381/330 |

FOREIGN PATENT DOCUMENTS

| | | | |
|---|---|---|---|
| EP | 1744589 | A2 | 1/2007 |
| JP | H08317496 | A | 11/1996 |
| JP | H1098346 | A | 4/1998 |
| JP | 2007028610 | A | 2/2007 |
| WO | 2014075195 | A1 | 5/2014 |

OTHER PUBLICATIONS

Martin, R: "Spectral Subtraction Based on Minimum Statistics", Signal Processing: Theories and Applications, vol. 2 (Sep. 13, 1994), pp. 1182-1185.

* cited by examiner

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

In a method for operating a hearing aid, an input signal is generated by way of one or more microphones. The input signal is amplified in an amplifier with an adjustable gain factor and output as an amplified input signal by way of a receiver. Furthermore, an OVD (own-voice-detection) parameter is established by an OVD unit. The OVD parameter specifies whether or not the user themselves is speaking. The gain factor is adjusted in a manner dependent on the OVD parameter and additionally adjusted in a manner dependent on noise, in particular stationary noise.

18 Claims, 1 Drawing Sheet

METHOD FOR OPERATING A HEARING AID AND HEARING AID

CROSS-REFERENCE TO RELATED APPLICATION

This application claims the priority, under 35 U.S.C. § 119, of German patent application DE 10 2015 204 639.7, filed Mar. 13, 2015; the prior application is herewith incorporated by reference in its entirety.

BACKGROUND OF THE INVENTION

Field of the Invention

The invention relates to a method for operating a hearing aid and to a hearing aid that is suitable therefor.

A hearing aid is typically used by a user for improving his hearing ability. To this end, the hearing aid comprises at least one microphone for recording sounds in the surroundings of the user, which sounds are then amplified in the hearing aid by means of an amplifier and output by way of a receiver. Here, different embodiments of the hearing aid are possible; these are worn differently by the user: for example, a CIC (completely-in-the-canal) device is worn completely within the ear, while it is only the receiver that is worn in the ear in the case of an RIC (receiver-in-canal) device, with the remaining components being worn behind the ear in a common housing, and all components are arranged in a common housing in the case of a BTE (behind-the-ear) device, with the sounds output by the receiver often being guided to the ear by way of a sound tube or the like.

The gain of an input signal generated by microphone is substantially determined by a gain factor adjusted in the amplifier. In order to have an ideal gain in different situations, it is known, as a matter of principle, to adjust the gain factor automatically in a suitable manner depending on the situation. By way of example, the gain factor is reduced in those situations in which the user of the hearing aid is speaking, because otherwise the rendition of the own voice is often perceived in a distorted manner, which is usually perceived as being unpleasant by the user.

By way of example, such an adaptation depending on the speech activity of the user is described in our commonly assigned earlier German patent application DE 10 2014 217 172.5, dated Aug. 28, 2014. Thus, the gain provided by the hearing aid is modified in one embodiment if the own voice is identified.

Commonly assigned U.S. Pat. No. 7,853,031 B2 and its counterpart European published patent application EP 1 744 589 A2 describe a hearing device and a method for own voice detection. The activity of the own voice is permanently registered and included in the control of algorithms in the hearing device, as a result of which artifacts and malfunctions, which are triggered by the own voice, are avoided. By way of example, an automatic gain control of the hearing aid is frozen if the own voice of the hearing aid wearer is present.

However, ambient sounds are correspondingly also amplified to a greater or lesser extent as a result of a dynamic, i.e. situation-dependent adjustment of the gain factor. Then, there is a frequent change in the gain factor in communication situations in particular, in which the user talks alternately with another person.

BRIEF SUMMARY OF THE INVENTION

It is accordingly an object of the invention to provide a hearing aid and a method of operating a hearing aid, which overcome the above-mentioned and other disadvantages of the heretofore-known devices and methods of this general type. It is the primary object to In the process, to at least reduce, and where possible avoid, the disadvantages which emerge from a dynamic adaptation of the gain factor depending on the voice of the user.

With the foregoing and other objects in view there is provided, in accordance with the invention, a method for operating a hearing aid, the method comprising:

generating an input signal by way of a microphone;

amplifying the input signal in an amplifier with an adjustable gain factor to form an amplified input signal; and outputting the amplified input signal by way of a receiver to a user;

establishing an own-voice-detection (OVD) parameter as a first parameter by an OVD unit, the OVD parameter specifying whether or not the user is speaking;

adjusting the gain factor in dependence on the OVD parameter and modifying the adjustment by additionally adjusting the gain factor in dependence on noise.

The hearing aid is worn by a user and it comprises at least a microphone for receiving sounds from the surroundings of the user, an amplifier and a receiver for outputting amplified sounds. In the method, an input signal which is amplified with an adjustable gain factor in the amplifier is generated by means of the microphone. In particular, in terms of a volume regulation, the gain factor is manually adjustable by the user by means of an operating element on a housing of the hearing aid or by means of a remote control.

The hearing aid furthermore comprises an OVD unit. The term OVD is an acronym for own voice detection. The OVD unit is used to establish an OVD parameter which specifies whether or not the user themselves is speaking. In particular, an own voice detection is implemented in this manner. Here, the OVD parameter is a first parameter. By way of example, the OVD parameter is realized as a Boolean parameter, which is true if the user is speaking and which is otherwise false. Alternatively, a continuous OVD parameter, for example, is also conceivable. In particular, a suitable OVD unit is described in the aforementioned, commonly assigned German patent application DE 10 2014 217 172.5, which is herewith incorporated by reference.

The gain factor is adjusted within a specific value range depending on the OVD parameter, as a result of which a dynamic gain adaptation is realized in own voice situations. In particular, alternating phases of speech and silence of the user over time characterize own voice situations, i.e. said user, for example, is having a conversation with another person. Within the scope of the dynamic gain adaptation, the input signal then is amplified dependent on whether the user is speaking or not. Preferably, the gain factor is reduced in a situation in which the user is speaking compared to a situation in which the user is not speaking.

According to the invention, the gain factor is additionally adjusted in a manner dependent on noise, which is not the own voice of the user but rather external noise in particular, for example the sound of an extractor or motor or, in general, ambient sound. To this end, there is a measurement, detection or estimation of the noise in particular. Thus, whether noise is present is initially established. In particular, the noise is stationary noise, which does not change at all, or only changes a little, over a relatively long period of time. Here, stationary is understood to mean, in particular, that the noise has an acoustic frequency spectrum with a mean level which changes by no more than 3 to 6 dB over a period of time of approximately 1 to 10 s. Expressed differently: the statistical properties of the frequency spectrum of the noise remain substantially constant over a specific period of time.

If ambient sound with a substantially constant volume level, i.e. stationary noise or a stationary interference signal, is present, particularly in a communication situation in which the user alternately speaks and does not speak, said ambient sound is also amplified accordingly—sometimes a little more and sometimes a little less. Examples of such stationary noise are ventilator and motor sounds in a vehicle. As a result of the time-varying gain of the stationary ambient sound due to a continuously adapted gain factor that depends on the speech activity of the user, there is, for the latter, a modulation of the ambient sound which he perceives as unpleasant. If no noise is present, in particular no stationary noise, i.e. if no noise is established, there is, in particular, a conventional gain adaptation depending on the OVD parameter.

A substantial advantage of the invention consists of the fact that, in particular, unpleasant modulation of stationary noise due to dynamic gain adaptation dependent on the own voice of the user is prevented, in particular by virtue of the value range of the dynamic gain adaptation being reduced in an advantageous manner. Expressed differently: in the case of a hearing aid with OVD functionality and a corresponding gain adaptation, the additional adjustment depending on noise prevents the unpleasant modulation of the latter, in particular by virtue of the modulation of the gain factor being reduced in a suitable manner due to the OVD unit. As a result of the gain adaptation depending on the OVD parameter, the amplified input signal, i.e. the output signal of the hearing aid, has a modulation depth which is adjusted, in particular reduced, in a manner dependent on the noise. A hearing aid operated in this manner offers a substantially improved hearing comfort, in particular since the own voice of the user is correctly rendered and, at the same time, modulation of otherwise stationary noise is avoided or at least reduced to a tolerable level.

A core concept in this case is, in particular, that the gain factor is not merely adjusted firstly as a function of the OVD parameter and secondly as a function of the noise, with these two dependencies being independent of one another. Rather, these two dependencies also influence one another, i.e. adjusting the gain factor in a manner dependent on the OVD parameter is itself dependent on the presence and/or the properties of noise. Depending on what noise situation is present, a different dynamic gain adaptation on account of the OVD parameter is expedient.

Therefore, overall, adjusting the gain factor in a manner dependent on the noise is directed to modifying the adjustment of the gain factor taking place in a manner dependent on the OVD parameter, namely in a manner dependent on the noise. By way of example, this is brought about by adjusting the value range of the dynamic gain adaptation depending on the noise, i.e. by a direct intervention in the dynamic gain adaptation. Alternatively or additionally thereto, there is an additional adjustment of the gain factor in order to counteract the adjustment depending on the OVD parameter, i.e. by way of the superposition of the dynamic gain adaptation, in order to modify the latter as an overall result. In general, "modifying" is understood to mean that ultimately there is an adaptation, compensation or change. In the present case, the gain adaptation is modified by an additional adjustment depending on noise. Consequently, it is not only the gain factor that is adjusted in a manner dependent on the OVD parameter, but rather the gain factor is adjusted in a manner dependent on the OVD parameter, taking noise into account. As a result, this then advantageously ensures that the gain adaptation in different noise situations is modified in an ideal manner due to the OVD unit in a manner dependent on the noise.

Within the scope of adjusting the gain factor by means of the OVD unit, the gain factor is usually reduced if the user speaks and increased if the user does not speak. However, compared to a hearing aid without such an additional adjustment depending on stationary noise, the gain factor is not reduced at all or reduced less in the case of speech activity of the user if stationary noise is present. As a result, a modulation of the noise in the case of alternating speech activity of the user then is correspondingly reduced, or avoided completely, and a more pleasant and more natural rendition of ambient sounds emerges for the user.

In a preferred embodiment, an intensity of the noise is established by means of a noise estimator and the gain factor is adjusted in a manner dependent on the intensity. Here, the intensity is a second parameter which is used to adjust the gain factor in addition to the OVD parameter. This intensity-dependent adaptation of the gain factor advantageously renders possible an ideal compromise between a reduction of the gain factor due to the own voice and a non-reduction in order to avoid a modulation of the noise.

Preferably, there is an adjustment to a higher gain factor in the case of own speech activity by the user in the case of a higher established intensity, i.e. in the case of louder noise, than in the case of a comparatively lower intensity, i.e. in the case of quieter noise, and there is an adjustment to a lower gain factor in the case of a lower established intensity than in the case of a comparatively higher intensity. As a result, the difference between the gain factor adjusted in the phases of own speech activity and the gain factor adjusted in the phases of own inactivity is advantageously reduced when changing the gain factor in a manner dependent on the OVD parameter. Own speech activity is understood to mean, in particular, that the user speaks, while the latter correspondingly does not speak in the case of own inactivity.

The described measure is based on the discovery that the modulation of noise with a low volume, i.e. a low intensity, is perceived to be less disturbing than the modulation of noise with a higher intensity in comparison therewith. Hence, the gain factor is reduced less proceeding from the gain factor in the case of own inactivity in an own voice situation with loud noise than in the case of quieter noise such that, in particular, the modulation of the noise on account of the switchover by means of the OVD unit is advantageously reduced in the case of louder noise. Hence, in a preferred embodiment, a first gain factor is adjusted at times of own speech activity of the user in the case of a first established intensity and a second gain factor is adjusted in the case of a second intensity, wherein the first gain factor is higher than the second gain factor if the first intensity is higher than the second intensity and lower if the first intensity is lower than the second intensity. By way of example, if the first intensity is approximately 50 dB and the second intensity is higher and approximately 80 dB, then there is an adjustment to a lower gain factor in the case of the first intensity than in the case of the second intensity, wherein both gain factors are respectively lower than the gain factor which is adjusted when the user does not speak. Then, louder noise is modulated less in comparison with quieter noise.

Therefore, in general, the change of the gain factor generated by the OVD unit is preferably reduced in the case of a higher established intensity and, in the process, there is an adjustment to a higher gain factor at times of own speech activity. Accordingly, the change of the gain factor is increased in the case of a lower intensity such that there is an adjustment to a lower gain factor at times of own speech activity. Preferably, the gain factor is adjusted at times of own speech activity in a manner proportional to the established intensity or, alternatively, in an under- or over-proportional manner.

The noise estimator establishes the intensity, i.e. the volume or the volume level of the noise, from the input signal in particular. In order to establish the intensity, use is preferably made of a method, in particular an algorithm, which only considers stationary components of noise. The advantage herein consists, in particular, of the fact that such a method, as a matter of principle, is only usable for establishing stationary noise and non-stationary noise is not detected. Since a modulation of non-stationary noise, i.e. already modulated noise in particular, is generally not perceived as disturbing by the user, it accordingly needs not be considered in the method for operating the hearing aid; instead, the gain factor is then adjusted in a manner substantially depending on the OVD parameter. Only if a stationary signal is present will the gain factor be additionally adjusted in a manner dependent on this only stationary noise. Conversely, an ideal OVD functionality of the hearing aid is ensured in the case of only modulated noise.

A particularly suitable method is a so-called minimum statistics method. Therefore, the intensity of the noise is established by means of a minimum statistics method in a suitable variant. The noise estimator is then embodied to carry out such a minimum statistics method and it establishes the intensity, i.e. the volume level, by a corresponding statistical evaluation of the input signal in particular. A possible embodiment of a minimum statistics method is described in e.g. Martin, R. (1994), "Spectral subtraction based on minimum statistics". A minimum statistics method can be implemented particularly easily and, as a matter of principle, it is only usable for establishing stationary noise, while non-stationary noise is substantially ignored, as a result of which the aforementioned advantages once again emerge.

In particular, the input signal is initially subdivided into a multiplicity of successive time intervals, from which a frequency spectrum, i.e. a spectrum in which a specific level is assigned to each frequency, is established in each case by means of a Fourier transform. The noise estimator is then used to establish the intensity, in particular by virtue of the level being measured in a number of frequency ranges of a respective frequency spectrum, said level then in particular corresponding to the intensity of the noise in the corresponding frequency range.

Expediently, there is no adaptation of the gain factor in a manner dependent on the intensity below a specific and, in particular, frequency-dependent minimum intensity, for example a sound pressure level of approximately 50 dB, since correspondingly quiet noise is perceived less strongly by the user than that with a higher intensity. By contrast, if stationary noise with a higher intensity than the minimum intensity is established, there additionally is an adaptation of the gain factor in order to avoid, or at least reduce, a possible modulation of the noise by the OVD unit.

In a further preferred embodiment, stationarity of the noise is established as a third parameter by means of a stationarity detector and the gain factor is adjusted in dependence on the stationarity. As a result, it is possible to distinguish between stationary and non-stationary noise in an improved manner. The stationarity is suitably established by means of a statistical examination of the input signal.

Therefore, the stationarity is established in a suitable embodiment as an intensity stability, for example as a variance of the mean level or of the level in a specific frequency range and over a specific period of time, i.e., in particular, over several frequency spectra. By way of example, the variance of the level is established at approximately 1 kHz over a period of time of approximately 1 s.

Additionally or alternatively, the stationarity is suitably established as a frequency stability. To this end, a maximum level is established, in particular in the frequency spectrum of the input signal, and the variance of the frequency assigned to this maximum level is established.

Additionally or alternatively, the stationarity is suitably established as a ratio of the levels of stationary and non-stationary components of the noise. To this end, the respective levels, in particular, are established and related to one another.

Moreover, a distinction is expediently made between stationary and non-stationary noise by virtue of predetermining a stationarity threshold. Then, if a stationarity which exceeds the stationarity threshold is established, the noise is considered to be non-stationary and there is no additional adjustment of the gain factor. However, if the stationarity is below the stationarity threshold, stationary noise is identified accordingly and the gain factor is adjusted accordingly.

In a preferred development, the parameters are each mapped to a scaling factor, for example in the range from 0 to 1, and the gain factor is adjusted by multiplication by the scaling factors. In general, the input signal is amplified by the gain factor predetermined by the amplifier. As a result of the initially predetermined gain factor being multiplied by a number of scaling factors, the gain factor is adjusted in a particularly simple manner, in each case in a manner dependent on the parameters, namely in a manner dependent on the OVD parameter, i.e. an OVD situation, the stationarity, i.e. the presence of stationary noise, and the intensity, i.e. the volume of the stationary noise.

The mapping carried out here, in particular, involves one in which a specific value of a parameter is assigned a value of the dimensionless interval 0 to 1. In particular, only a restricted value range of a respective parameter is mapped onto the interval. By way of example, the intensity is only mapped for sound pressure levels in a range from approximately 50 to 80 dB, wherein, in the case of a higher sound pressure level, i.e. a higher intensity and when the user does not speak, there should be a higher gain and, accordingly, an intensity of 80 dB is assigned to the scaling factor 0 and an intensity of 50 dB is assigned to the scaling factor of 1. Within the restricted value range, the assignment is linear or logarithmic for example; outside, there is a corresponding assignment to a constant value of 0 or 1.

Preferably, the scaling factors are initially combined to form an overall scaling factor and the gain factor is adjusted by multiplication by the overall scaling factor. Here, this combination is carried out, in particular, by means of a multiplier with the scaling values as input values and the overall scaling factor as output value. This then, in particular, maps the result of a scene analysis, which is carried out by the hearing aid in respect of the speech activity of the user and the presence of stationary noise.

The input signal is typically composed from various frequencies which, in particular, form an acoustic frequency spectrum with a number of frequency ranges. Moreover, different frequencies or frequency ranges of the frequency spectrum are often amplified to a different extent since, for example, greater importance is apportioned to a specific frequency range. Therefore, the gain factor is preferably also adjusted in a frequency-dependent manner; to this end, in particular, the scaling factors are frequency-dependent, i.e. a function of the frequency in each case.

In an expedient development, there is in each case an independent adjustment of the gain factor in different frequency ranges, which are also referred to as frequency bands. Preferably, frequency regions with different importance are in this case subject to an appropriately adapted dynamic gain adaptation in a manner independent of one another and according to requirements.

Expediently, e.g. the aforementioned establishment of the intensity is also restricted to a frequency range which is influenced most by the gain, i.e. in which the frequency-dependent gain factor is at a maximum.

In order to carry out the method, the hearing aid has, in particular, a control unit. The latter is connected to the amplifier in a suitable manner and it comprises appropriate modules for adjusting the gain factor. In particular, the modules are the OVD unit and the noise estimator and/or the stationarity detector. In the process, for example, an embodiment of the control unit as an application-specific integrated circuit, a so-called ASIC, is conceivable, wherein the modules are in each case realized as a part of this circuit. Alternatively, an embodiment as a programmable microcontroller is also possible, in which the modules are realized partly or wholly as program modules.

In conclusion, the advantages of the invention consist of, in particular, an extended dynamic adaptation which takes into account stationary noise being undertaken in addition to a dynamic adaptation of the gain factor in a manner dependent on the speech activity of the user of the hearing aid. To this end, the intensity and/or stationarity in particular is/are established as characteristic parameter(s) of the respective stationary noise and used to adapt the gain factor. For particularly effective modification of the gain factor, the established parameters are mapped onto scaling factors.

Other features which are considered as characteristic for the invention are set forth in the appended claims.

Although the invention is illustrated and described herein as embodied in a method for operating a hearing aid and a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
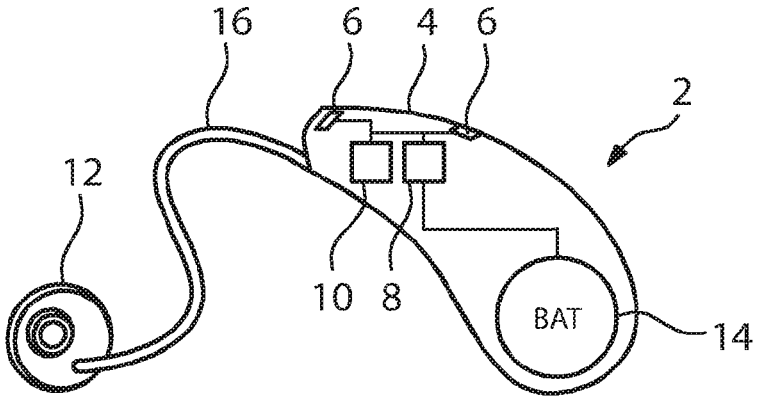
FIG. 1 is a schematic view of a hearing aid.

Referring now to the figures of the drawing in detail and first, particularly, to FIG. 1 thereof, there is shown a hearing aid 2 which, in this case, is a so-called RIC (receiver-in-the-canal) device. The device comprises a housing 4 which is worn behind the ear of a user. The hearing aid 2 furthermore comprises, as important components, a plurality of microphones 6, a control unit 8, an amplifier 10 and a receiver 12. Furthermore, a battery 14 is present for the energy supply.

The microphones 6 are used to generate an input signal E, which, during operation, is forwarded to the amplifier 10 for gain and amplified there by a specific gain factor V. The input signal E amplified in this manner is then output by way of the receiver 12, more precisely by way of a loudspeaker (not shown here in any more detail) of the receiver 12. In the exemplary embodiment shown here, the receiver 12 is worn directly in the ear by the user and connected to the amplifier 10 by means of a suitable supply line 16. However, in principle, it is also possible for the hearing aid 2 to be a BTE (behind-the-ear) device, in which the receiver 12 is attached in or on the housing 4. In that case, the supply line 16 is embodied as a sound tube. By contrast, in a further possible alternative, the hearing aid 2 is a CIC (completely-in-the-canal) device, which is worn completely in the ear, or a concha hearing device.

Figure 2:
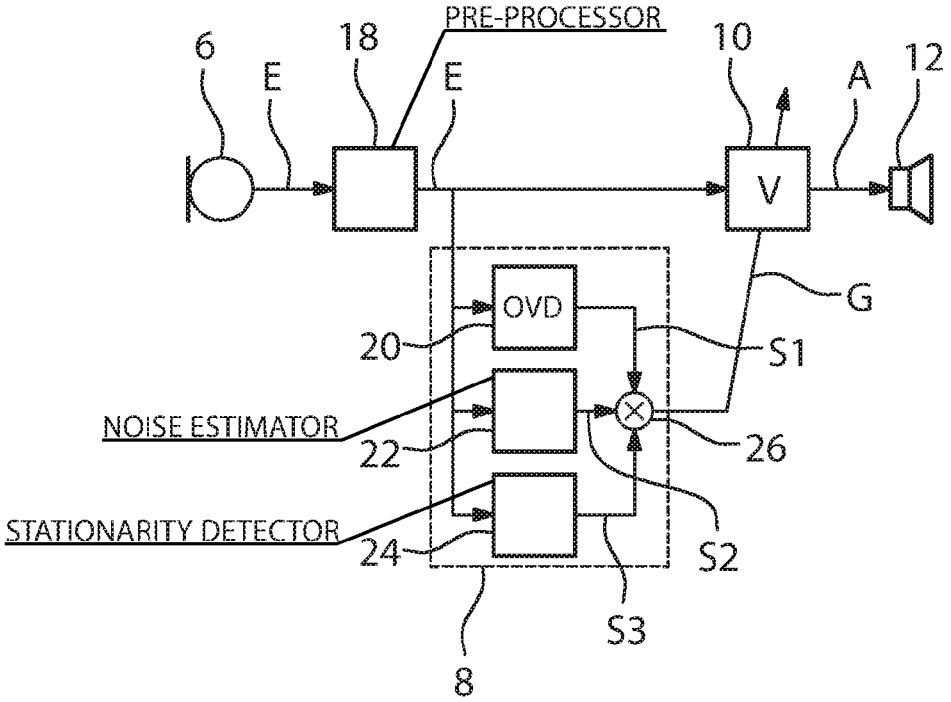
FIG. 2 is a schematic connection diagram of the hearing aid.

Below, a method for operating the hearing aid 2 is described in more detail on the basis of the connection diagram shown in FIG. 2. What can be clearly identified initially is the generation of the input signal E by means of at least one microphone 6, the gain thereof by the gain factor V in the amplifier 10 to form the output signal A and, finally, the output thereof by way of the receiver 12. In the exemplary embodiment shown here, there moreover is additional processing, for example filtering or the like, prior to the gain by way of a preprocessor 18. Therefore, the preprocessor 18 generates a modified input signal E, which, for simplicity, is likewise referred to as input signal E below.

The gain factor V is adjustable by way of the control unit 8. In addition thereto, the gain factor may also be adjustable in another manner (not shown in any more detail), for example manually by way of an operating element (not depicted here) on the hearing aid 2. In FIG. 2, the gain factor V is adjusted by the control unit 8 by way of an overall scaling factor G, which is provided by the control unit 8. Here, the conventionally used gain factor V is multiplied by the overall scaling factor G in order to obtain an adapted gain factor V.

The overall gain factor G is the result of an analysis of the input signal E carried out by the control unit 8. Here, the analysis is substantially carried out in respect of the speech activity of the user and possible noise in the surroundings of the user. To this end, the control unit 8 comprises a number of modules, in this case three modules 20, 22, 24, namely an OVD unit 20, a noise estimator 22 and a stationarity detector 24. These each generate a scaling factor S1, S2, S3 on the basis of characteristic parameters which are established from the input signal E. These three scaling factors S1, S2, S3 are combined to form an overall scaling factor G by way of a multiplier 26.

Specifically, an OVD parameter is initially established by means of the OVD unit 20 in the exemplary embodiment shown here, which OVD parameter specifies whether the user is speaking, i.e. whether speech activity of the user is present. If this is the case, the gain factor V should be reduced; otherwise, it should be increased. To this end, the OVD parameter is mapped onto the scaling factor S1 in a range between 0 and 1. By way of example, the mapping is carried out in such a way that the scaling factor S1 is 0 in the case of own speech activity of the user and otherwise it is 1. Then, depending on the situation, the gain factor V is adjusted in such a way that there is either no gain or maximum gain. Alternatively, there is a gradation, e.g. due to the level, i.e. the volume of the voice of the user.

Noise possibly also recorded is analyzed by means of the noise estimator 22, to be precise in respect of the intensity thereof. Here, only stationary noise is of particular interest. Therefore, the analysis in this case is carried out by means of a minimum statistics method. In particular, the established intensity as a characteristic parameter of the noise specifies the volume thereof and it is therefore a measure for the volume of stationary background sounds. The intensity is now mapped onto the scaling factor S2 in such a way that stationary noise is modulated as little as possible by the OVD unit 22 when adapting the scaling factor S1, and to be precise the modulation should decrease with the volume of the noise. Accordingly, there is no adaptation, or only a small adaptation, of the gain factor V by means of the scaling factor S2 of the noise estimator 22 in the case of a low intensity. By contrast the scaling factor S1 predetermined by the OVD unit 20 is counteracted in the case of a high intensity.

The stationarity detector 24 additionally establishes the extent to which the noise is in fact stationary noise. To this end, the input signal E is examined in respect of the development thereof over time in order to establish stationarity. Here, the intensity stability and frequency stability in particular are examined statistically in one or more frequency ranges and, for example, variances of specific levels or frequencies are established in the frequency spectrum of the input signal E. These variances are then mapped to a scaling factor S3 in order to exert further influence on the gain factor V.

In this manner, the gain factor V is adjusted by means of the modules 20, 22, 24 in a manner dependent on the acoustic overall situation around the user. Here, there is an adjustment depending on the speech activity of the user by the OVD unit 20 and an adjustment depending on a stationary noise by the modules 22, 24. Here, it is possible, by means of the modules 22, 24, to compensate for or at least reduce negative effects when adapting the gain factor V by the OVD unit.

The invention claimed is:

1. A method for operating a hearing aid, the method comprising:

generating an input signal by way of a microphone;

amplifying the input signal in an amplifier with an adjustable gain factor to form an amplified input signal; and outputting the amplified input signal by way of a receiver to a user;

establishing an own-voice-detection (OVD) parameter as a first parameter by an OVD unit, the OVD parameter specifying whether or not the user is speaking;

adjusting the gain factor in dependence on the OVD parameter and within a value range, thereby realizing a dynamic gain adaption within the value range and reducing the gain factor if the user speaks and increasing the gain factor if the user does not speak, wherein the dynamic gain adaption leads to a modulation of noise in a case of alternating speech activity of the user; and modifying the dynamic gain adaption by additionally adjusting the gain factor in dependence on the noise by reducing the value range of the dynamic pain adaption in a case of louder noise so as to reduce the modulation of the noise due to the gain adaption.

2. The method according to claim 1, wherein the noise is stationary noise.

3. The method according to claim 1, which comprises establishing an intensity of the noise as a second parameter by a noise estimator and adjusting the gain factor in dependence on the intensity.

4. The method according to claim 3, which comprises taking into account only stationary components of noise in establishing the intensity.

5. The method according to claim 3, which comprises establishing the intensity of the noise by way of a minimum statistics method.

6. The method according to claim 3, which comprises establishing a stationarity of the noise as a third parameter by way of a stationarity detector and adjusting the gain factor in dependence on the stationarity.

7. The method according to claim 6, which comprises mapping each of the parameters onto a scaling factor and adjusting the gain factor by multiplication by the scaling factors.

8. The method according to claim 7, which comprises initially combining the scaling factors to form an overall scaling factor and adjusting the gain factor by multiplication by the overall scaling factor.

9. The method according to claim 1, which comprises, in a case of speech activity by the user, adjusting a higher gain factor in a case of a higher established intensity than in a case of a comparatively lower intensity; and adjusting a lower gain factor in a case of a lower established intensity than in a case of a comparatively higher intensity.

10. The method according to claim 9, which comprises taking into account only stationary components of noise in establishing the intensity.

11. The method according to claim 9, which comprises establishing the intensity of the noise by way of a minimum statistics method.

12. The method according to claim 1, which comprises establishing a stationarity of the noise as a further parameter by way of a stationarity detector and adjusting the gain factor in dependence on the stationarity.

13. The method according to claim 12, which comprises establishing the stationarity by determining a frequency stability and/or intensity stability of the noise.

14. The method according to claim 1, which comprises adjusting the gain factor in a frequency-dependent manner.

15. The method according to claim 1, which comprises carrying out an independent adjustment of the gain factor in each case in different frequency ranges of the input signal.

16. A hearing aid, comprising:

a microphone for generating an input signal;

an amplifier connected to receive the input signal and for amplifying the input signal by a specific gain factor to form an amplified input signal;

a receiver for outputting the amplified input signal; and a control unit connected to said receiver, said control unit including an own-voice-detection (OVD) unit configured to establish an OVD parameter as a first parameter, the OVD parameter specifying whether or not the user himself or herself is speaking; and said control unit being configured to adjust the gain factor in dependence on the OVD parameter and within a value range, thereby realizing a dynamic gain adaption within the value range and reducing the gain factor if the user speaks and increasing the gain factor if the user does not speak, wherein the dynamic pain adaption leads to a modulation of noise in a case of alternating speech activity of the user; and said control unit also being configured to modify the dynamic gain adaption by additionally adjusting the gain factor in dependence on the noise by reducing the value range of the dynamic gain adaption in a case of louder noise so as to reduce the modulation of the noise due to the gain adaption.

17. The hearing aid according to claim 16, configured to carry out the method according to claim 1.

18. A method for operating a hearing aid, the method comprising:

generating an input signal by way of a microphone;

amplifying the input signal in an amplifier with an adjustable gain factor to form an amplified input signal;

outputting the amplified input signal by way of a receiver to a user;

establishing an own-voice-detection (OVD) parameter as a first parameter by an OVD unit, the OVD parameter specifying whether or not the user is speaking;

adjusting the gain factor in dependence on the OVD parameter, thereby realizing a dynamic gain adaption in own-voice-situations;

the amplified input signal having a modulation depth as a result of the dynamic gain adaption; and adjusting the modulation depth in a manner dependent on noise, by reducing the dynamic gain adaption in case of louder noise.

* * * * *